US006926223B2

(12) United States Patent
Schüttrichkeit

(10) Patent No.: US 6,926,223 B2
(45) Date of Patent: Aug. 9, 2005

(54) METHOD FOR WINDING OF FILAMENTS

(75) Inventor: Heinz Schüttrichkeit, Kelsterbach (DE)

(73) Assignee: Zimmer A.G., Frankfurt am Main (DE)

( * ) Notice: Subject to any disclaimer, the term of this patent is extended or adjusted under 35 U.S.C. 154(b) by 0 days.

(21) Appl. No.: 10/482,321

(22) PCT Filed: May 7, 2002

(86) PCT No.: PCT/EP02/04995

§ 371 (c)(1),
(2), (4) Date: Dec. 29, 2003

(87) PCT Pub. No.: WO03/008315

PCT Pub. Date: Jan. 30, 2003

(65) Prior Publication Data

US 2004/0173711 A1 Sep. 9, 2004

(51) Int. Cl.[7] ..... B65H 54/00; B65H 54/40

(52) U.S. Cl. ..... 242/486; 242/486.3; 242/486.4; 242/178; 242/477

(58) Field of Search ..... 242/486, 486.3, 242/486.4, 481.7, 477, 477.3, 477.6, 178

(56) References Cited

U.S. PATENT DOCUMENTS

| | | | | |
|---|---|---|---|---|
| 4,307,848 A | * | 12/1981 | Barathieu | 242/486 |
| 4,697,753 A | * | 10/1987 | Schippers et al. | 242/477.6 |
| 4,765,552 A | | 8/1988 | Sugioka et al. | |
| 4,986,483 A | | 1/1991 | Ryu et al. | |
| 5,634,081 A | * | 5/1997 | Krakirian | 710/74 |
| 5,824,248 A | | 10/1998 | Sweet et al. | |
| 5,934,601 A | * | 8/1999 | Migaki et al. | 242/477 |
| 5,962,131 A | | 10/1999 | Schwind et al. | |
| 6,090,485 A | | 7/2000 | Anderson et al. | |

FOREIGN PATENT DOCUMENTS

| | | |
|---|---|---|
| DE | 100 63 286 A1 | 12/2000 |
| JP | 62-244873 A | 10/1987 |
| JP | 63-147780 A | 6/1988 |
| JP | 11-263534 A | 9/1999 |
| WO | WO 99/07927 | 2/1999 |
| WO | WO 99/51799 | 10/1999 |

OTHER PUBLICATIONS

Patent Abstracts of Japan, vol. 8, No. 87, published Apr. 20, 1984.

Patent Abstracts of Japan, vol. 1995, No. 1, published Feb. 28, 1995.

Patent Abstracts of Japan, vol. 1996, No. 5, published May 31, 1996.

Patent Abstracts of Japan, vol. 12, No. 404, published Oct. 26, 1988.

Franz Fourné, "Synthetic Fibers, Machines and Equipment, Manufacture Properties, Handbook for Plant Engineering, Machine Design, and Operation", pp. 207–210, 397–401, Hanser Publishers, Munich.

* cited by examiner

*Primary Examiner*—Kathy Matecki
*Assistant Examiner*—Evan H Langdon
(74) *Attorney, Agent, or Firm*—McDonnell Boehnen Hulbert & Berghoff LLP

(57) ABSTRACT

The invention relates to a method for winding pre-oriented, non-crystalline polyester filaments onto a spool at a winding speed of at least 4,200 m/min, in which the wound filament is wound over the width of the spool by means of a flying traverse arm and is turned by a driven sensing roller with an applied pressure between 8 and 18 kg on the circumference of a spool placed on a driven spool-locating pin. The filaments for winding are introduced to the traverse thread guide at a thread tension of between 0.03 cN/dtex and 0.20 cN/dtex. The sensing roller is driven at an overspeed of preferably between 0.3 and 1.2%, in comparison with the spool circumferential speed. The thread laying angle is set between 3.5° and 7.5° by means of the spool travel. The above method permits a good spool formation even at high spooling speeds.

10 Claims, 1 Drawing Sheet

METHOD FOR WINDING OF FILAMENTS

Figure 1:
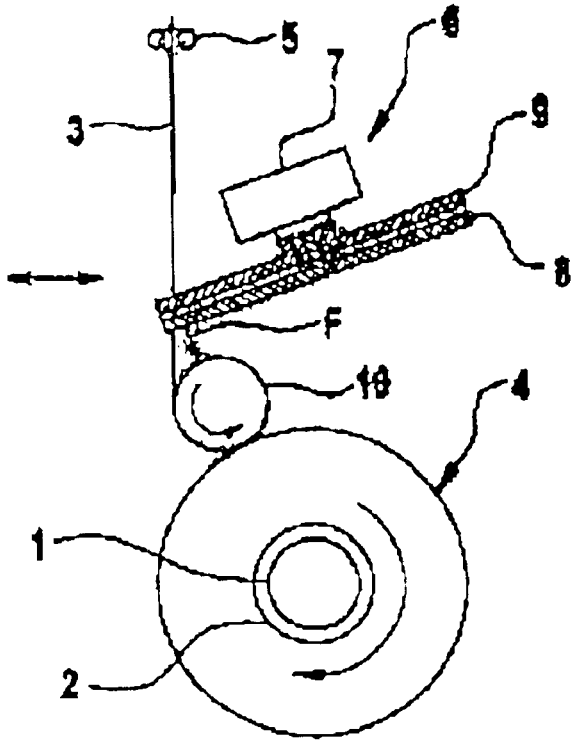

The present invention relates to a process for winding up filaments to form a package at high winding speeds. Specifically the invention relates to a process for winding up POY polyester filaments.

The yarn package is the most important form of storing, processing or shipping yarn. Yarn packages have to meet high requirements. More particularly, the yarn package should not affect the yarn's properties and should have good unwinding properties.

A good package build requires high precision of the package surface speed. Various ways of driving the package are known. In spindle drive, the spindle holding the package is driven and its surface speed is varied. As the package diameter increases, the rotational speed of the spindle decreases. It is known to measure the surface speed using a feeler roll which rests against the surface of the package. As the package diameter increases over the winding time of the yarn, the surface speed increases. This increase is transmitted to the rotational speed of the feeler roll. A control signal is generated to reduce the rotational speed of the spindle as the package diameter increases. In the case of friction drive, a presser roll resting against the surface of the package drives the undriven spindle at a constant surface speed.

There are also spindle-drive winding machines where the feeler or friction roll is likewise equipped with a motor drive for the purpose of measuring the surface speed. This makes available an additional variable which is known as the gain of the feeler roll compared with the package.

A positive gain generates a command signal to the drive of the feeler roll to increase the speed, and a negative gain generates a signal to reduce speed. In either case, the feeler roll remains in contact with the package, so that the feeler roll exerts either an accelerating or a decelerating effect on the package. In the case of Bamag's CW winder, the gain is set by means of a load displacement factor, which is defined in scale divisions. A positive gain is set using a positive load displacement factor with the scale value approximately characterizing per mill (‰) units of the gain.

Various traversing systems are known for placing the yarn across the width of the package to be wound. There are yarn guides which move forward and backward and whose direction of movement is abruptly reversed at the package edge, and this leads to appreciable acceleration forces and can contribute to very rapid wear. Rotating propeller systems, in contrast, move the yarns forward and backward substantially more quickly, but the yarn may be exposed to a shocklike stress at the point where it reverses direction.

Polyester POY filaments are customarily produced at takeoff speeds of 2 500–3 500 m/min, depending on the linear density to be produced. Such filaments have breaking extension values of 75–165%, which have proved advantageous for further processing in a drawing or draw-texturing operation.

However, on increasing the winding speed, akin to the production of spin-oriented, crystalline FOY or HOY PET filaments, there are increasing defects, which induce process and quality upsets when the filaments are unwound from the packages for the purpose of further processing.

The production of POY yarns at high winding speed is described for example in the following references:

WO 99/51799 discloses a process for spinning continuous filaments by cooling the freshly spun filaments in a tube using an accelerated cooling gas. This makes it possible to raise the spinning takeoff speed to 4 530 m/min without reducing the breaking extension of the filaments.

WO 99/07927 describes a process for producing POY filaments from polyester-based polymer blends. PES filaments having high breaking extension values are obtained in the presence of a certain amount of an additive copolymer even at high spinning takeoff speeds of up to 6 000 m/min.

Although the cited processes make it possible to spin POY filaments at high takeoff speeds, the winding up of the filaments and the avoidance of package defects has not been further described.

It has been found in commercial practice that filaments produced at high spinning takeoff speeds can give rise to the following defects in windup:

- The high centrifugal forces due to the rotating package are responsible for an uncontrolled collapse of the package when the full package is braked.
- High friction forces between the surface of the package and the feeler roll lead to flexing and to a buildup of heat.
- Especially bellying at the package flanks, saddle formation across the width of the package and dropped ends. These defects can arise or worsen even during the storage of the POY packages.
- In this context, it must be borne in mind that the spinning takeoff speed is defined by the speed of the first takeoff element, usually a godet, and the winding speed corresponds to the surface speed of the package.

The literature identifies the most frequent causes for defective package build as being a wrong wind per double traverse and a wrong winding tension onto the package. Increasing excessive winding tension will initially cause the yarn to build up at the ends, so that the package forms a saddle in the middle, and will then cause dropped ends and broken ends. Insufficient yarn tension will initially give rise to a ribbony surface, associated with bulging package ends, an increasing number of dropped ends and, in the event of even greater yarn overfeeding, loop formation, broken ends and wraps on the friction roll (Franz Fourné, Synthetische Fasern, Carl Hanser Verlag Munich Vienna, 1995, pages 210 ff.).

A winding machine with a driven contact roll and a driven package holder is known from JP 63-147 780 A. A winding method for highly crystalline yarns is described. But the stated winding parameters are not applicable to noncrystalline yarns. Besides, the angle of wind is not specified. The setting of an identical speed for the package surface and the contact roll means that dropped coils at the ends of the package are unavoidable.

JP 62-244873 A likewise describes a winding machine with contact roll and package holder which are driven. Here too the focus is on the winding of highly crystalline yarns. Therefore, there is again a requirement for agreement between the speeds of the contact roll and of the package surface. Dropped ends are likewise unavoidable.

JP 11-263534 A concerns the winding up of acrylic fiber. But the change in the winding tension as the package builds up is not acceptable for PES yarns.

It is an object of the present invention to provide a process for winding up POY polyester filaments whereby good package build can be obtained even at high winding speeds. The process shall further provide a package build to provide high yarn weights on the package of more than 4 kg, preferably 12–32 kg, and good package unwinding process at further processing even after prolonged storage of the package.

This object is achieved according to the invention by the features indicated in claim 1. Advantageous modifications of the process according to the invention form the subject matter of subclaims.

It has been determined that, surprisingly, good package build is obtainable in the case of POY polyester filaments even at high winding speeds on feeding the filaments to be wound up to the traversing filament guide at a yarn tension between 0.03 cN/dtex and 0.20 cN/dtex, operating the feeler roll at a positive gain compared with the package surface speed, setting the angle of wind to be between 3.5° and 7.5° throughout the package, and setting the contact force of the feeler roll on the package surface between 8 and 18 kg.

Yarn refers to the bundled multifilaments. POY filaments are in particular filaments having a breaking extension between 75 and 165%. All polyesters can be used, for example PET, PBT, PTT or the like.

The winding tension in cN/dtex at which the filaments to be wound up are fed to the traversing yarn guide is determined by forming the quotient of the yarn tension in cN measured directly above the traversing yarn guide and the linear density in dtex of the wound-up yarn. The process of the invention does not absolutely presuppose the use of godets. When the filaments are taken off using godets, the yarn tension which is measured is the yarn tension of the filaments fed by the last takeoff godet to the traversing yarn guide. The yarn is laid over the traverse length by means of rotating propellers.

The setting of the mandated force with which the feeler roll presses against the surface of the package ensures a frictional connection between the package and the roll.

Angle of wind refers to the angle between the yarn direction on the package and the perpendicular to the axis of rotation of the package. An angle of wind between 3.5° and 7.5° throughout the package contributes to stabilizing the package build.

Owing to the positive gain at which the feeler roll is operated compared with the package surface speed, the feeler roll exerts an accelerating effect on the package. It has been determined that, surprisingly, the accelerating effect has a substantial influence on the avoidance of dropped coils especially when POY is produced at high winding speeds.

Setting the angle of wind within the abovementioned limits contributes to the fact that the package is devoid of saddle formation and bellying.

Particularly good package build is obtained when the feeler roll is operated at a positive gain of between +0.3 and +1.2% compared with the package surface speed. The traversing yarn guide is preferably fed with the filaments at a yarn tension between 0.05 cN/dtex and 0.15 cN/dtex.

To further improve package build, the angle of wind of the filaments is preferably varied throughout the package as a function of the package diameter. Varying the angle of wind is a way of imposing further limitations on transportation damage and unwinding defects due to bellying. It is particularly advantageous for the angle of wind in a first phase to increase with increasing package diameter and in a subsequent, second phase to decrease with increasing package diameter throughout the package. The angle of wind preferably increases and decreases incrementally in approximately 0.5° steps. Between the first and second phases, the angle of wind is preferably kept constant.

In the context of the present invention, the PES may also comprise a small fraction, preferably up to 0.1% by weight, based on the total weight of the filament, of brancher components. Preferred brancher components according to the invention include polyfunctional acids, such as trimellitic acid or pyromellitic acid, or tri- to hexavalent alcohols, such as trimethylolpropane, pentaerythritol, dipentaerythritol, glycerol or corresponding hydroxyacids.

In may further be advantageous to admix the PES with up to 2.5% by weight, based on the total weight of the filament, of additive polymers as extensibility enhancers. Particularly useful additive polymers according to the invention include polymers and/or copolymers. The disclosure content of DE 10063286 is incorporated herein in this respect by reference.

The process according to the invention can in principle utilize all customary winding machines whereby the parameters mentioned can be set. It is advantageous for the process of the invention to use a spinning-cooling means which reduces stress-induced crystallization at high spinning takeoff speeds. A particularly preferred embodiment of the present invention utilizes a spinning-cooling means as described in WO 99/51799. The disclosure of this reference is explicitly incorporated herein in this context by reference.

The filaments may be entangled in a conventional manner before being wound up. Any entangling is preferably done to node counts of at least 10 n/m (measured on the wound-up yarn).

For the yarn tension to be set according to the invention, the winding speed of the POY polyester filaments should be 0 to 2% below the package takeoff speed. When the filaments are taken off using godets, the takeoff speed refers to the circumferential speed of the first godet unit.

It is further advantageous to employ a pattern-breaking mechanism in order that trapped yarn coils may be avoided in the extreme package positions specifically.

Figure 2:
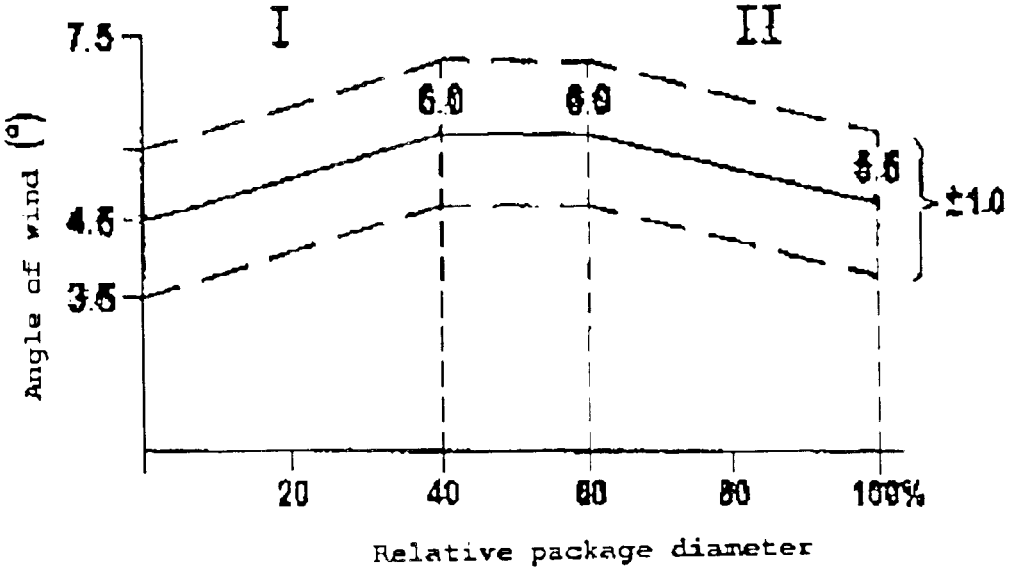

The process of the invention will now be more particularly described with reference to the drawings, in which FIG. 1 shows a greatly simplified diagrammatic depiction of a winding machine for use in the process of the invention and FIG. 2 shows the variation in the angle of wind throughout the package.

In the process of the invention, a melt of the polyester or polymer blend is pumped by spinning pumps into spinneret packs to be extruded through the holes in the die plate of the pack to form molten filaments. The extruded filaments pass through a quench delay zone. A reheater can be disposed below the spinning beam. The filaments are subsequently cooled to temperatures below the solidification temperature.

Means for cooling filaments are known from the prior art. The filaments may be cooled using for example single end systems comprising single cooling tubes having a perforated wall. Cooling of each individual filament is obtained through active cooling air supply by utilizing the self-suction effect of the filaments and/or through aspiration of the cooling air. As an alternative to the individual tubes, it is also possible to use the familiar crossflow quench systems.

The bundling of the filaments to form at least one end takes place in an oiler pin which supplies the yarn with the desired amount of spin finish at a uniform rate. Before being wound up, the filaments of the yarn may be entangled to improve bundle coherency on the package.

The winding machine for winding up the continuously arriving yarn comprises a motor-driven package mandrel 1 onto which the package or bobbin former 2 has been pushed. It is on the package former 2 that the yarn 3, continuously arriving at a constant speed, is wound to form a package 4.

The yarn 3 initially passes through a yarn guide 5, which forms the tip of the traversing triangle. The yarn then arrives at a traversing means 6. The winding machine preferably possesses a propeller wheel traverse motion (depicted only in outline) which comprises a traverse drive 7 and two counterrotating propeller systems 8, 9 per yarn. Such a rotor type yarn laying system forms part of the prior art and is described for example in Fourné, Synthetische Fasern, Carl Hansa Verlag Munich Vienna, 1995, page 401.

The propellers 8, 9 of the rotor type traversing system move the yarn 3 back and forth over the traverse length. The yarn tension at which the arriving filaments are fed to the traversing yarn guide is between 0.03 cN/dtex and 0.20 cN/dtex and preferably in the range from 0.05 cN/dtex and 0.15 cN/dtex. The magnitude of the frequency of the traversing means 6 is varied to set an angle of wind for the yarn of between 3.5 and 7.5° throughout the package.

Below the traversing means 6, the yarn is redirected by more than 90° at a feeler roll 10 and then wound up on the package former 2 to form the package 4. The feeler roll 10 has a separate drive. The directions of rotation of the package mandrel 1 and of the feeler roll 10 are each identified by arrows. The contact force F of the feeler roll bearing against the surface of the package can be varied on the winding machine. The contact force F is set between 8 and 18 kilograms.

The rotational speed of the package mandrel 1 is varied so that the package surface speed is constant. Irrespective of the variation of the package mandrel, the drive of the feeler roll 10 is set to positive gain, so that it exerts an accelerating effect on the package. This positive gain between feeler roll drive compared with package mandrel drive is preferably between +0.3 and +1.2%.

The angle of wind is varied within the limits of 3.5° and 7.5° throughout the package. FIG. 2 shows the angle of wind (°) as a function of the package diameter (%) relative to the full package (100%). At the start, the angle of wind is preferably set to 4.5°. In a first phase I up to a relative package diameter of 40%, the angle of wind is incrementally increased from 4.5° to 6°. Subsequently, the angle of wind remains constant within this range up to a relative package diameter of 60%. This is followed by a second phase II, in which the angle of wind is incrementally decreased from 6.0° to 5.5°. The upper and lower limits between which the angle of wind should be set throughout the package are shown as broken lines in FIG. 1. The upper and lower limits are each 1.0° above and below, respectively, the particularly preferred values.

Other winding machines differ in their geometry, the hardware and the process control system. The winder conditions of the invention provide stable, defect-free packages. The filaments are formed into packages at a winding speed of at least 4 200 m/min, preferably ≧4 600 m/min and especially ≧6 000 m/min. A range which is particularly preferred in the context of the invention is that between 4 200 and 8 000 m/min and especially between 4 600 and 7 000 m/min.

What is claimed is:

1. A process for winding up POY polyester filaments to form a package at winding speeds of at least 4,200 m/min by the arriving filaments being fed to a traversing yarn guide, being laid over the traverse length of the package and being redirected by a driven feeler roll which bears with a mandated contact force against the surface of the package which sits on a driven mandrel, wherein it comprises feeding the filaments to be wound up to the traversing filament guide at a relatively high yarn tension between 0.03 cN/dtex and 0.20 cN/dtex, operating the feeler roll at a higher surface speed than the package surface speed, setting the angle of wind between 3.50 and 7.50 degrees throughout the package, and setting the contact force of the feeler roll between 8 kg and 18 kg.

2. The process as claimed in claim 1, wherein the feeler roll (press roll) is operated at a positive gain of between 0.3% and 1.2% for its surface speed compared with the package surface speed.

3. The process as claimed in claim 1, wherein the filaments are fed to the traversing yarn guide at a tension of 0.05 cN/dtex to 0.15 cN/dtex.

4. The process as claimed in claim 1, wherein the angle of wind of the filaments is varied throughout the package as a function of the package diameter.

5. The process as claimed in claim 4, wherein the angle of wind in a first phase increases with increasing package diameter and in a subsequent, second phase decreases with increasing package diameter throughout the package.

6. The process as claimed in claim 5, wherein the angle of wind is kept constant between the first and second phases.

7. The process as claimed in claim 1, wherein the traversing yarn guide is fed with an entangled yarn having at least 10 nodes/m.

8. The process as claimed in claim 1, wherein the filaments are wound up at a speed between 4,600 and 7,000 m/min.

9. The process as claimed in claim 1, wherein the arriving filaments are laid down by means of rotating propeller systems.

10. The process as claimed in claim 7 wherein the filaments are wound up at a speed between 4,600 and 7,000 m/min.

* * * * *